US010001349B2

(12) United States Patent
Côté et al.

(10) Patent No.: US 10,001,349 B2
(45) Date of Patent: Jun. 19, 2018

(54) TARGET ATTACHMENT SYSTEMS, MAIN FRAME FOR RECEIVING DIFFERENT TARGET ATTACHMENT SYSTEMS AND METHODS OF USING THE SAME

(71) Applicant: 9091-4532 QUEBEC INC., L'Isle-Verte (CA)

(72) Inventors: Etienne Côté, L'Isle-Verte (CA); Alexandre Côté, L'Isle-Verte (CA)

( * ) Notice: Subject to any disclaimer, the term of this patent is extended or adjusted under 35 U.S.C. 154(b) by 0 days. days.

(21) Appl. No.: 15/184,695

(22) Filed: Jun. 16, 2016

(65) Prior Publication Data

US 2016/0370153 A1 Dec. 22, 2016

Related U.S. Application Data

(60) Provisional application No. 62/180,164, filed on Jun. 16, 2015.

(51) Int. Cl.
*F41J 1/10* (2006.01)
*F41J 7/04* (2006.01)

(52) U.S. Cl.
CPC .. *F41J 1/10* (2013.01); *F41J 7/04* (2013.01)

(58) Field of Classification Search
CPC ..... F41J 1/10; F41J 7/04
USPC ..... 273/390–392
See application file for complete search history.

(56) References Cited

U.S. PATENT DOCUMENTS

| | | | | |
|---|---|---|---|---|
| 5,240,258 | A * | 8/1993 | Bateman | F41J 1/10 273/392 |
| 5,324,043 | A * | 6/1994 | Estrella | F41J 7/04 273/391 |
| 6,776,418 | B1 * | 8/2004 | Sovine | F41J 1/10 273/407 |
| 6,779,797 | B1 * | 8/2004 | Chou | F41J 7/04 273/391 |
| 7,175,181 | B1 * | 2/2007 | Bateman | F41J 7/04 273/392 |
| 7,681,886 | B2 * | 3/2010 | Morrow | F41J 1/10 273/366 |
| 8,684,361 | B2 | 4/2014 | Henson et al. | |
| 9,574,855 | B2 * | 2/2017 | Davis | F41J 5/205 |
| 2006/0125185 | A1 * | 6/2006 | Rolfe | F41J 7/04 273/390 |
| 2008/0174071 | A1 * | 7/2008 | Potterfield | F41J 1/10 273/392 |

(Continued)

*Primary Examiner* — Mark Graham
(74) *Attorney, Agent, or Firm* — Benoit & Cote, Inc.; C. Marc Benoit

(57) ABSTRACT

A target system for receiving a target having a target body and target projection extending therefrom. The target system comprises a main frame and a target attachment system. The main frame comprises an elongated target receiving member defining an elongated target receiving member surface and two vertically distant projections extending from the elongated target receiving member surface. The target attachment system comprises pair of target attachment supports adapted for being distantly and concurrently mounted on the projections, each one of the target attachment supports having an opening therethrough. The target attachment supports are mounted as a pair, and are defining a passage defined by their openings, the passage being adapted for receiving the target projection. As a result, the target, when hit on the target body, rotates freely around a rotation axis defined by the passage.

9 Claims, 16 Drawing Sheets

(56) References Cited

U.S. PATENT DOCUMENTS

| | | | | |
|---|---|---|---|---|
| 2011/0074110 | A1* | 3/2011 | Markley | F41J 7/04 273/392 |
| 2012/0193872 | A1* | 8/2012 | Henson | F41J 1/01 273/348 |
| 2012/0205870 | A1* | 8/2012 | Saunders | F41J 7/04 273/392 |
| 2013/0328268 | A1 | 12/2013 | Eggiman et al. | |
| 2015/0260487 | A1* | 9/2015 | Steil | F41J 7/04 273/390 |
| 2016/0209184 | A1* | 7/2016 | Anderson | F41J 7/04 |

* cited by examiner

TARGET ATTACHMENT SYSTEMS, MAIN FRAME FOR RECEIVING DIFFERENT TARGET ATTACHMENT SYSTEMS AND METHODS OF USING THE SAME

CROSS-REFERENCE TO RELATED APPLICATION

This application claims priority from U.S. patent application 62/180,164 filed Jun. 16, 2015, the specification of which is hereby incorporated herein by reference in its entirety.

BACKGROUND

(a) Field

The subject matter disclosed generally relates to target attachment systems and to methods of using the same. More particularly, the subject matter relates to main frames capable of receiving interchangeable/different target attachment systems, to target attachment systems, to target systems and to methods of using the same.

(b) Related Prior Art

Steel targets are targets for firearms made from hardened (i.e., martensitic) steel, and are used in sports, practical/dynamic shooting and for long range shooting. They are popular in both training and competition as the shooter gets immediate feedback on whether it's a hit or a miss in the form of sound, and one can also often see the bullet getting pulverized and the target move. A common trademark in the USA for hardened steel used in the production of targets is AR500.

There currently exists on the market a plurality of target attachment systems for receiving one or more steel target(s) and for installation at a particular distance from the shooter. However, these known target attachment systems have some drawbacks.

For example, almost all target attachment systems require important storage space for storing the targets and the target attachments system separately.

Also, even if shooters know that allowing for quick turnovers of a range and less down time can make the difference between a successful event and a long day at the range; modifying the target attachment system in different configurations to practice different skills is still a challenge that can be hard, long and require equipment and sophisticated tools.

Additionally, different types of target attachment systems are often required for different shooting exercises (such as standard plate rack and gravity plate rack), and so different types of main frames are required, which requires important investments and precious time to mount and demount such frames and their target attachment receiving systems.

There is therefore a need for improved target attachment systems and improved methods of using the same.

SUMMARY

According to an embodiment, there is provided a main frame for mounting target holders, the main frame comprising:

an elongated target receiving member defining an elongated target receiving member surface;

a first elongated projection extending from the elongated target receiving member surface; and a second elongated projection, vertically distant from the first elongated projection, extending from the elongated target receiving member surface, wherein the first elongated projection and the second elongated projection cooperate in mounting the target holders.

According to an aspect, the first elongated projection and the second elongated projection comprise channels which are configured in pairs, each of the pairs comprising a first channel defined in the first elongated projection and a second channel defined in the second elongated projection vertically aligned with the first channel.

According to an aspect, wherein the elongated target receiving member comprises a ricochet face downwardly and forwardly angled, wherein the ricochet face is adapted to ricochet bullets toward a ground surface.

According to an aspect, at least one of the first elongated projection and the second elongated projection extends horizontally, thereby defining a non-square angle between the at least one of the first elongated projection and the second elongated projection and the elongated target receiving member surface.

According to an aspect, part of the target holders contact the at least one of the first elongated projection and the second elongated projection thereunder thereby preventing upward movement of the target holders.

According to an aspect, the main frame further comprises a support member interfacing with a ground surface and on which is mounted the elongated target receiving member at a given distance above the ground surface.

According to an embodiment, there is provided a target attachment system for mounting to a main frame and for holding a target movable between a shooting position and a shot position, the target having a target body and a target projection extending therefrom, the target attachment system comprising:

a pair of target holders for mounting to the main frame distant from each other, each one of the target holders comprising:

a target mounting face for mounting on the main frame; and a holder body having an opening therethrough;

wherein the target holders are mounted as a pair, thereby defining a pair of openings creating a horizontal passage having a rotation axis therein, and wherein the horizontal passage is adapted to receive the target projection and whereby the target, when hit, rotates about the rotation axis from the shooting position to the shot position.

According to an aspect, each opening comprises an interior arch, and wherein each opening has a rest surface within the interior arch on which abuts the target in a rest angle whereby the target is partially facing a ground surface.

According to an aspect, each opening has an abutment surface in the interior arch where the target abuts to stop a rotation of the target around the rotation axis.

According to an aspect, the interior arch has an irregularity between the rest surface and the abutment surface, wherein the irregularity provides resistance against the target rotating around the rotation axis away from the rest angle.

According to an aspect, each of the target holders has an exterior face distant from the target mounting face, the exterior face comprising an exterior arch, and the wherein the target holders comprise a rest surface on the exterior arch on which abuts the target in a rest angle whereby the target is partially facing a ground surface.

According to an aspect, the target holders further comprise an abutment surface on the exterior arch where the target abuts to stop a rotation of the target around the rotation axis.

According to an aspect, the exterior arch comprises an irregularity between the rest surface and the abutment surface, wherein the irregularity provides resistance against the target rotating around the rotation axis away from the rest angle.

According to an aspect, the target attachment system further comprises a mounting member adapted for securing together a first one of the target holders, a second one of the target holders and the main frame.

According to an aspect, one of the target holders has an open ring-shaped frame portion defining an insert channel creating a passage for the target projection to the opening, the one of the target holders further comprising a retainer portion adapted to be placed in a first position freeing the insert channel and in a second position obstructing the insert channel and thereby preventing the target projection from exiting the opening.

According to an embodiment, there is provided a target system for receiving a target having a target body and target projection extending therefrom, the target system comprising:

a main frame comprising:

an elongated target receiving member, the elongated target receiving member defining an elongated target receiving member surface; and a first elongated projection extending from the elongated target receiving member surface; and a target attachment system comprising:

a first target holder and a second target holder adapted for being distantly and concurrently mounted to the first elongated projection, each one of the first target holder and the second target holder having an opening therethrough;

wherein the first target holder and the second target holder are mounted as a pair thereby defining a pair of openings creating a horizontal passage having a rotation axis therein, the horizontal passage being adapted for receiving the target projection, and wherein the target projection operates within the opening so that the target, when hit, rotates freely about the rotation axis.

According to an aspect, the target system further comprises a second elongated projection, vertically distant from the first elongated projection, extending from the elongated target receiving member surface, wherein the first target holder and the second target holder are adapted for being distantly and concurrently mounted to the second elongated projection.

According to an aspect, the target system further comprises a mounting member adapted for securing together the first target holder, the second target holder and the main frame.

According to an aspect, the target rotates between a rest angle and a hit angle, the target system further comprising a target repositioning mechanism mounted to the main frame, wherein, when a force is applied on the target repositioning mechanism, a rotation of the target is initiated whereby the target rotates back toward the rest angle.

According to an aspect, the target repositioning mechanism comprises one of a pushing arm and a stopping arm.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

In embodiments, there are disclosed main frames capable of receiving a plurality of target attachment systems, target attachment systems, target systems comprising a main frame and a target attachment system, and methods of using the same.

Figure 1:
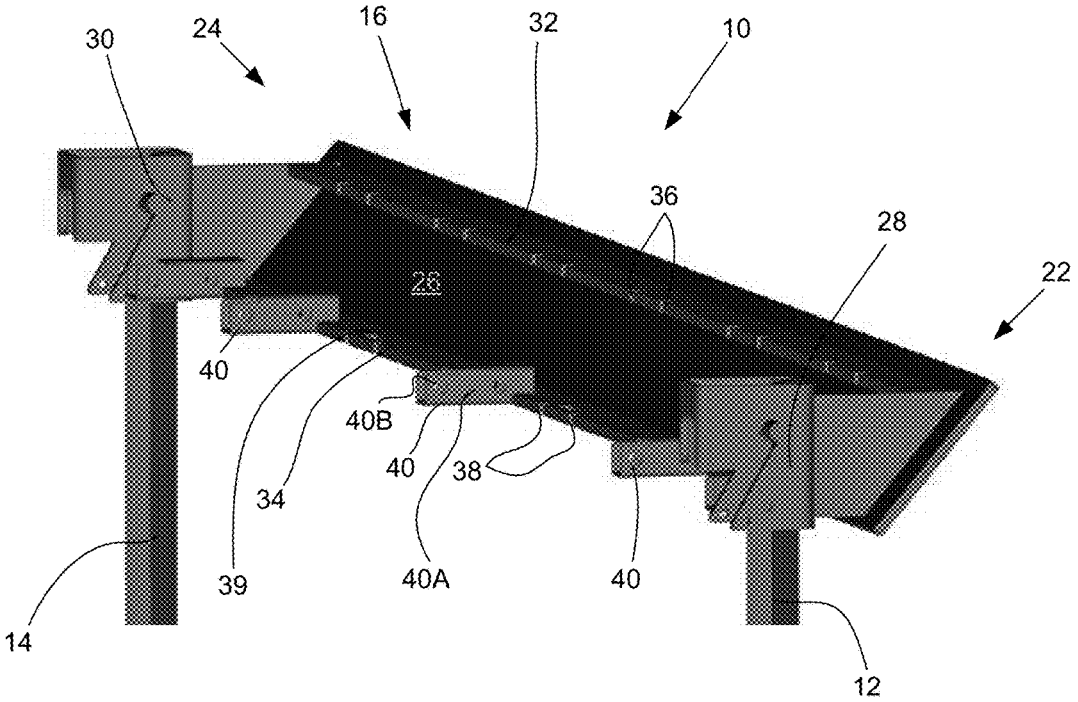
FIG. 1 is a rear perspective view of a main frame capable of receiving different target attachment systems in accordance with an embodiment.

Referring now to the drawings, and more particularly to FIG. 1, there is shown a main frame 10 that can be used for a plurality of different target attachment systems (as it will be described below).

Figure 2:
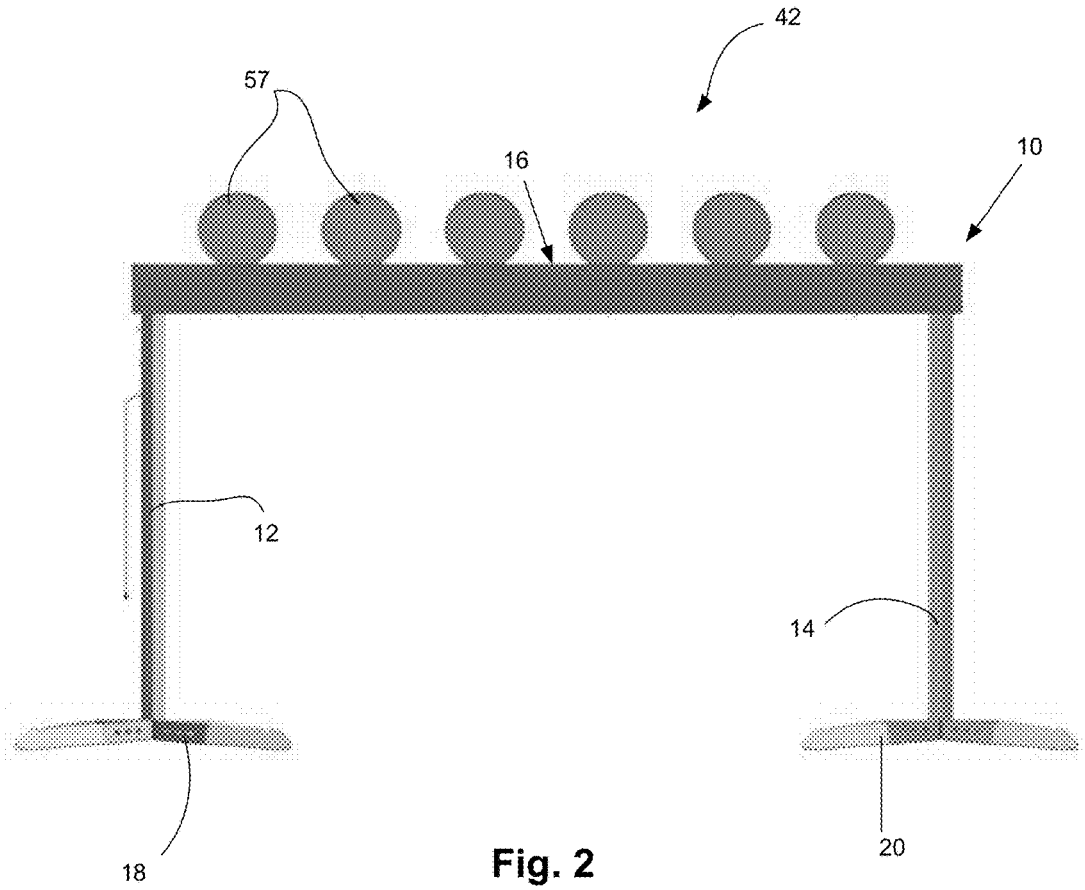
FIG. 2 is a front elevation view (shooter's point of view) of a first target attachment system releasably mounted on the main frame of FIG. 1 in accordance with another embodiment.

The main frame 10 includes a first (rightmost) elongated post 12 and a second (leftmost) elongated post 14, which is distant from the first elongated posts 12. The main frame 10 further includes an elongated target receiving member 16 which is supported by the first and second elongated posts 12, 14. Referring to FIGS. 1 and 2, there is shown that the main frame 10 further includes a first base (rightmost) member 18 which has the role of supporting the first elongated posts 12 and a second (leftmost) base member 20 which has the role of supporting the second elongated post 14. Therefore, as shown in FIG. 1, the main frame 10 is a self-standing frame.

Still referring to FIGS. 1 and 2, there is shown that the first and second elongated posts 12, 14 are removably mounted on their respective base members 18, 20. Moreover, there is further shown that the elongated target receiving member 16 is removably supported by/mounted on the first and second elongated posts 12, 14. Indeed, the first elongated post 12 is supporting a first end 22 of the elongated target receiving member 16 and the second elongated post 14 is supporting a second end 24 of the elongated target receiving member 16.

Figure 3:
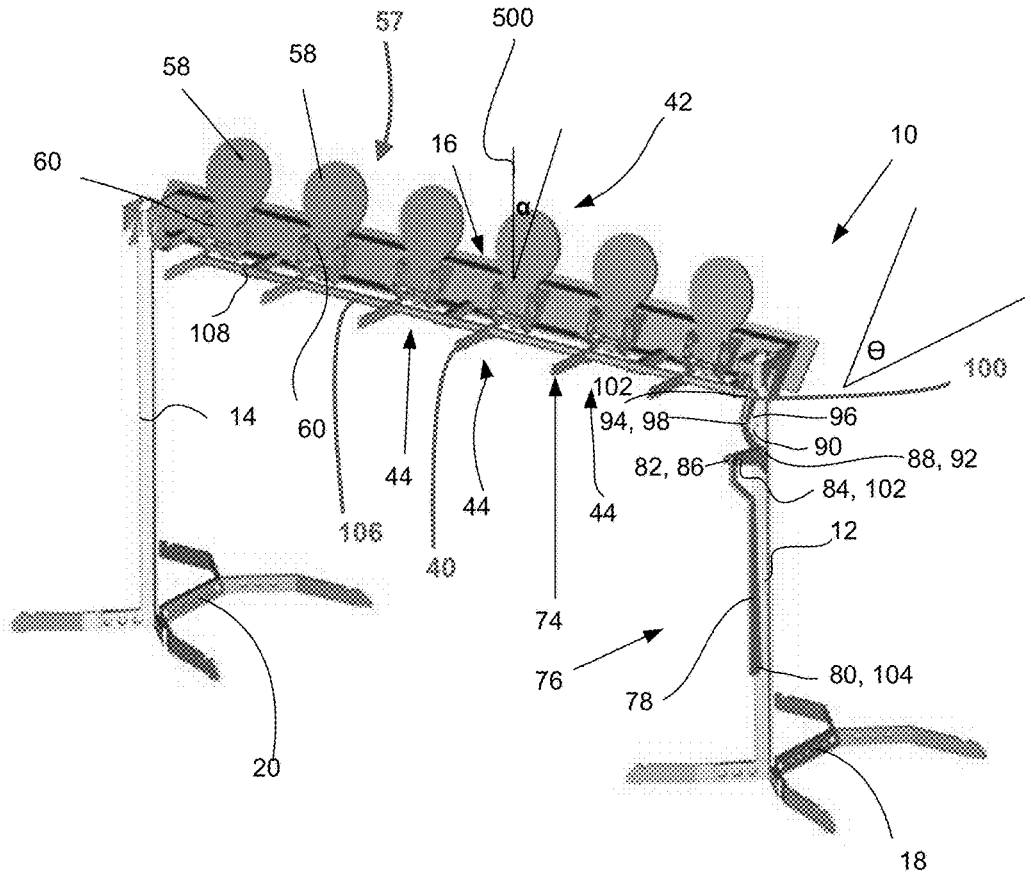
FIG. 3 is rear perspective view of the first attachment system releasably mounted on the main frame of FIG. 2.

Still referring to FIG. 1 in addition to FIG. 3, there is shown that the elongated target receiving member 16 defines an elongated target receiving member surface 26 and that there exists an angle θ between the elongated target receiving member surface 26 and a horizontal surface (i.e., the ground surface) (FIG. 3).

Still referring to FIG. 1, the main frame 10 further includes a first connection frame element 28 for releasably attaching the first end 22 of the elongated target receiving member 16 to the first elongated post 12. The main frame 10 further includes a second connection frame element 30 for releasably attaching the second end 24 of the elongated target receiving member 16 to the second elongated post 14.

The main frame 10 further includes a first elongated projection 32 extending from the elongated target receiving member surface 26 along the length of the elongated target receiving member 16 from its first end 22 to its second end 24. The main frame 10 further includes a second elongated projection 34, which is vertically distant from the first elongated projection 32, and which is also extending from the elongated target receiving member surface 26 along the length of the elongated target receiving member 16 from its first end 22 to its second end 24. Each one of the first and second elongated projections 32, 34 include a plurality of spaced apart channels 36, 38 (first channel and second channel) and the second elongated projection 34 further includes a plurality of spaced apart slots 39. It is to be noted that channels 36, 38 are configured to be in pairs; i.e., two vertically aligned channels 36, 38 as can be understood from the more detailed description below.

Still referring to FIG. 1, there is shown that each one of the first and second elongated projections 32, 34 define an upper surface that is substantially parallel to the ground surface (not shown).

Still referring to FIG. 1, there is shown that the main frame 10 further includes a plurality of extending members 40 which are mounted on (which are extending from) the second elongated projection 34 to extend outwardly from the elongated target receiving member surface 26 (such as to be substantially parallel to the ground surface). Each one of the extending members 40 defines a body 40A and openings 40B therethrough for receiving a connector (such as an elongated pin) or a reset mechanism, as it will be described below.

It is to be noted that the main frame 10 may be made of AR500 steel. However, it is to be mentioned that the main frame 10 may alternatively be made of any other suitable material that may offer appropriate resistance to bullet impacts.

As mentioned above, and according to its configuration, the main frame 10 is capable of receive a plurality of target attachment systems, as will be described below.

According to another embodiment, and referring now to FIGS. 2-8 and more particularly to FIGS. 2-3, there is shown that the main frame 10 receives a first target attachment system 42. The first target attachment system 42 includes a plurality of spaced apart target supports 44 to be removably mounted on the elongated target receiving member 16 of the main frame 10 along a target mounting face 43.

Each one of the target supports 44 includes a first target holder 46 (FIG. 4) which includes a first holder body 48 and a first cam shaped opening 50 therethrough. Each target support 44 further includes a second target holder 52 which is laterally distant from the first target holder 46. The second target holder 52 includes a second holder body 54 and a second cam shaped opening 56 therethrough. Targets 57 are releasably mounted to the first target attachment system 42.

Figure 4:
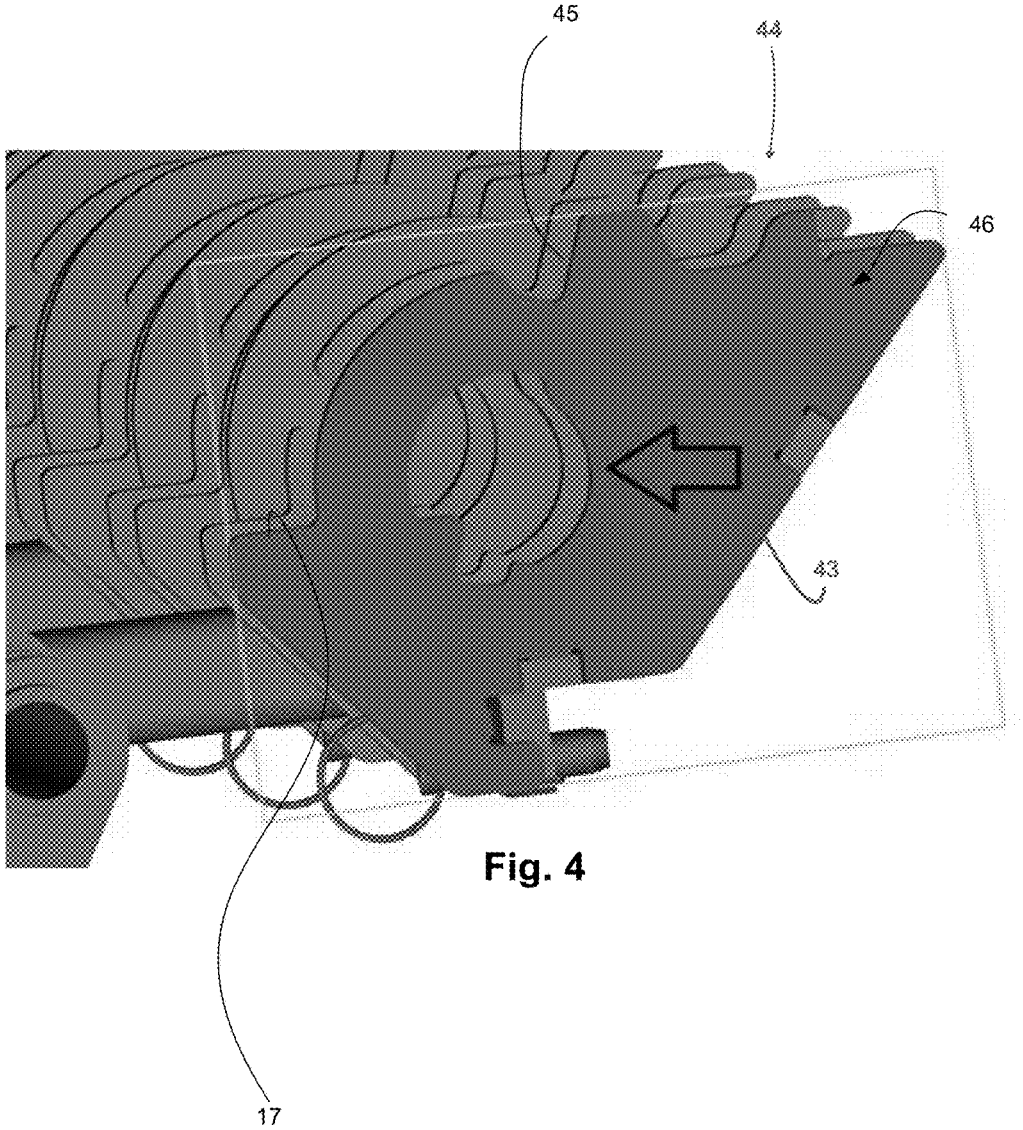
FIG. 4 is a close up perspective view of a first attachment system in accordance with another embodiment, showing a plurality of spaced apart target supports.
Figure 5:
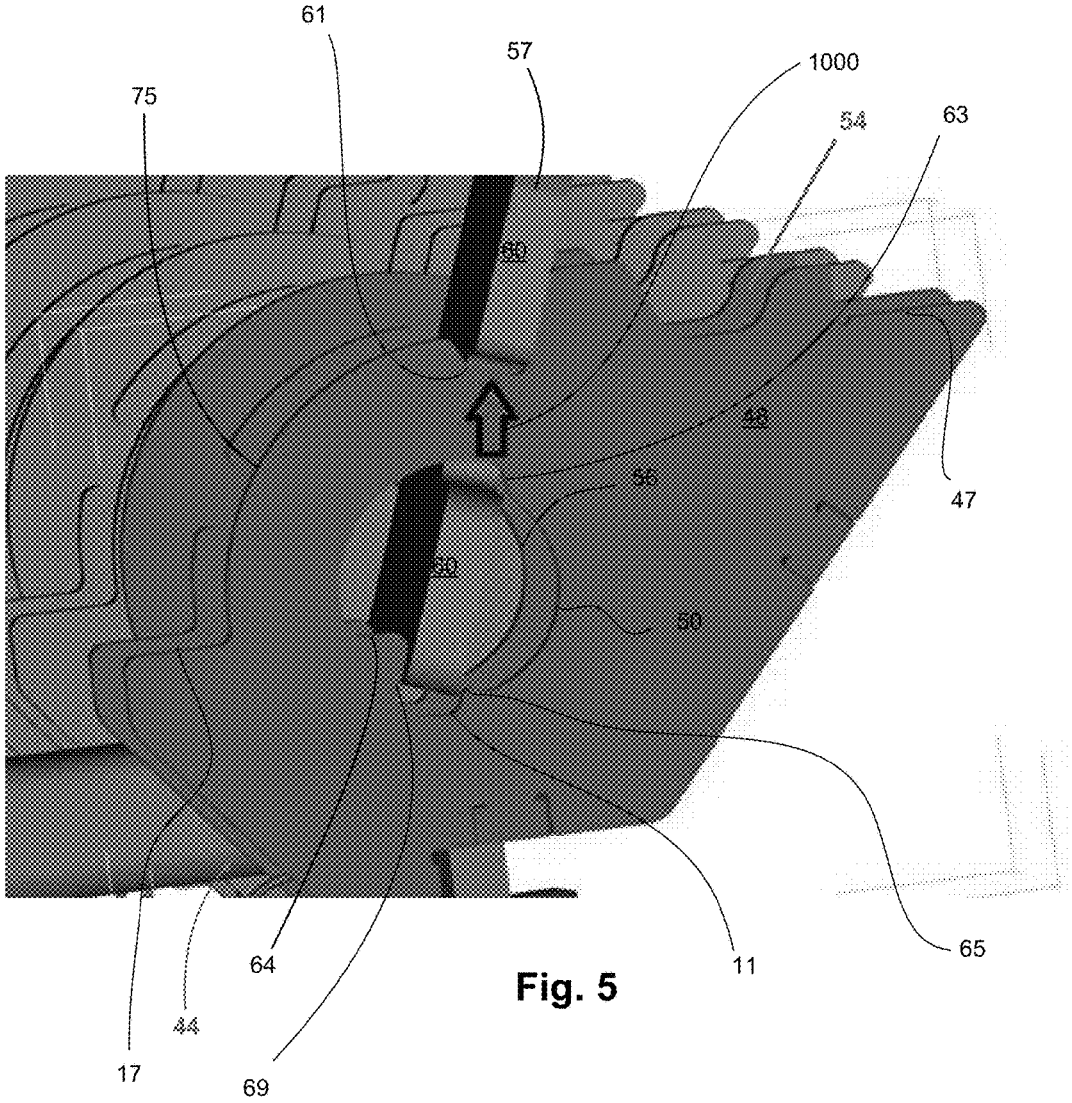
FIG. 5 is another close up perspective view of the first attachment system of FIG. 4, showing a target support receiving a target projection.
Figure 6:
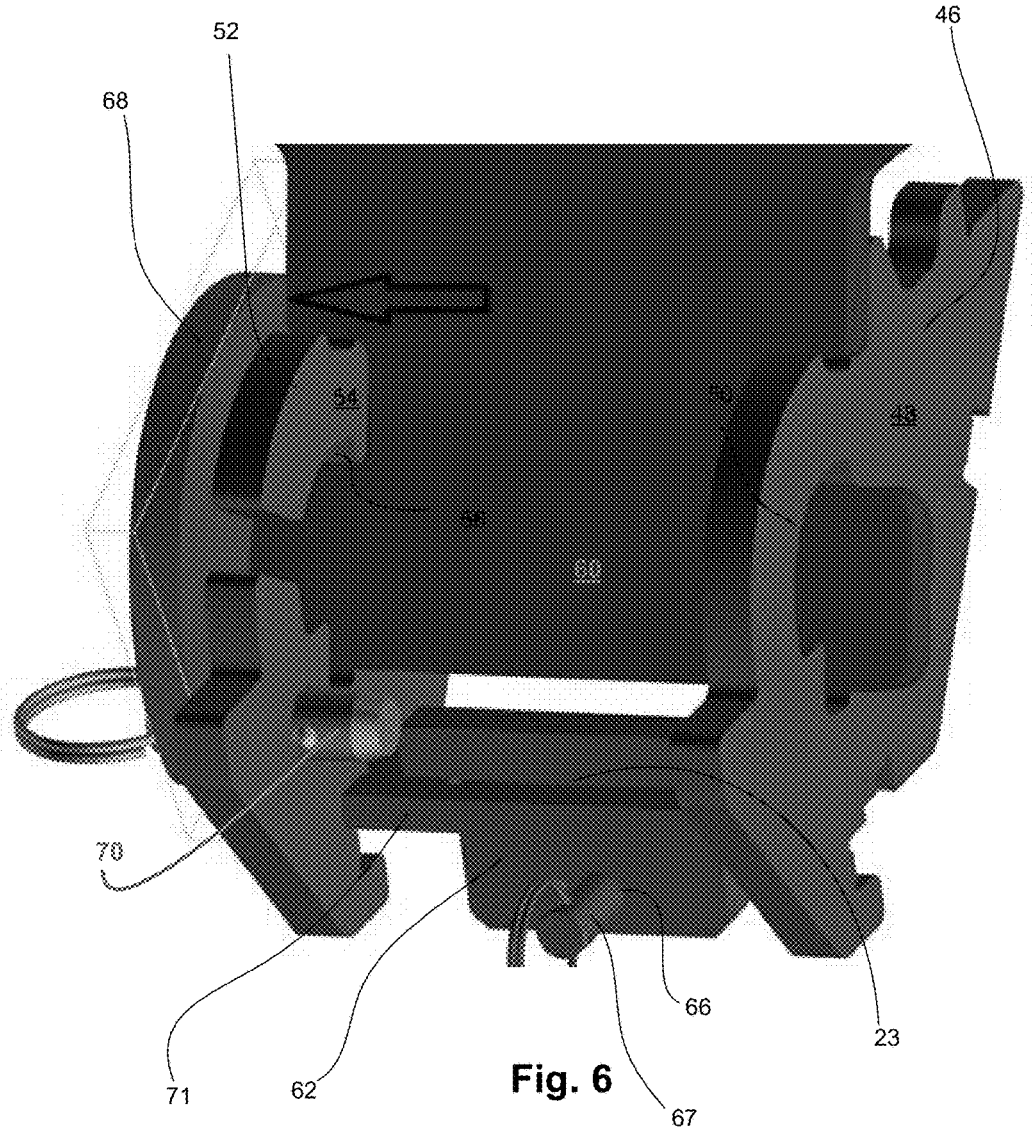
FIG. 6 is another close up perspective view of the first attachment system of FIG. 5, showing the target support receiving a target projection and further showing a retainer portion for retaining the target body.

As shown in FIGS. 2-8 and particularly in FIGS. 3, 5 and 6, targets 57, which are to be releasably mounted to the first target attachment system 42 each includes a target body 58 and a target projection 60, which extends from the target body 58. It is the target projection 60 that will cooperate with the first and second cam shaped openings 50, 56 of the first and second target holders 46, 52 (FIG. 6). The first and second target holders 46, 52 are attached together via joining member 71 which has a slot 23 therein. Each one of the first and second holder bodies 48, 54 further defines a recess 61 for supporting the target body 58 (just above the target projection 60). It is to be mentioned that such recess 61, combined with the presence of first and second cam shaped openings 50, 56, allows for reduction of risks of an accidental target movement. Indeed, such recesses 61 in first and second holder bodies 48, 54 help in maintaining each target 57 in place when in their shooting position (when targets 57 are upwardly extending from their respective target support 44) by forcing the target 57 to remain into a small depression (the recesses 61) on the top of the first and second holder bodies 48, 54 (on the top of the arc defined by the target supports 44). Accordingly, if the target 57 is hit, it must first rise out from the recesses 61 to further complete its rotational cycle between the target shooting position (when target 57 is up) and the shot position (when target 57 is down and substantially parallel to the ground surface). Therefore, because of the angle α of about 20° between the target 57 and the vertical 500 (FIG. 3), shooting a given target 57 (but not a portion of the main frame 10, another target 57, or a portion of the first target attachment system 42) will allow the target 57 to fall backward.

As best shown in FIGS. 3 and 5, because of the angle α of about 20° that is present between the target 57 and the vertical 500, when a shooter hits the target 57, an upward vertical component of the force provided by the bullet will allow the target projection 60, which was laying in the cam recess 11 on the wall 69, to move up and out of the cam recess 11 in the direction of arrow 1000 (directed by the wall 69) over the recess lip 65. According to the configuration of the wall 69, which is slightly higher than the recess lip 65, target projection 60 will travel along the redirection lip 63 and will thereby cause the target 57 to rotate (counterclockwise in FIG. 5) and fall in its substantially horizontal position, so that the target 57 does not rest on the substantially vertical rest surface 45 anymore, but rather on the stopper 17 (FIGS. 4-5).

Thus, as illustrated in FIG. 5, the interior of the opening 50 features two interior arches along which part of the target projection 60 travels when rotating from its shooting position to its shot position. One interior arch presents a rest surface (the wall 69) about an end, which participates in defining the shooting position of the target 57, and an irregularity (the cam recess 11) that provides resistance against the rotation of the target 57. The other interior arch presents an abutment surface 64 on which will rest the target 57 in the horizontal shot position once shot at the end of its rotation.

Still referring to FIG. 5, the exterior of the holder body 48 distant from the main frame 10 (FIG. 1) also features an exterior face comprising an exterior arch 75 along which part of the target projection 60 travels when rotating from its shooting position to its shot position. The exterior arch 75 presents a rest surface (the vertical rest surface 45, FIG. 4) about an end and an irregularity (the recess 61) that provides resistance against the rotation of the target 57 when in shooting position. The exterior arch also presents an abutment surface (the stopper 17) on which will rest the target 57 in the horizontal shot position at the end of its rotation.

It is to be noted that both the inside and the outside profiles of the holder body 48 are provided to control the course of the target 57 from a shooting position and a shot position, as to prevent accidental movement of the target 57. However, one may decide to incorporate only one of these profiles (i.e., only the inside profile or only the outside profile) in some circumstances.

Figure 16:
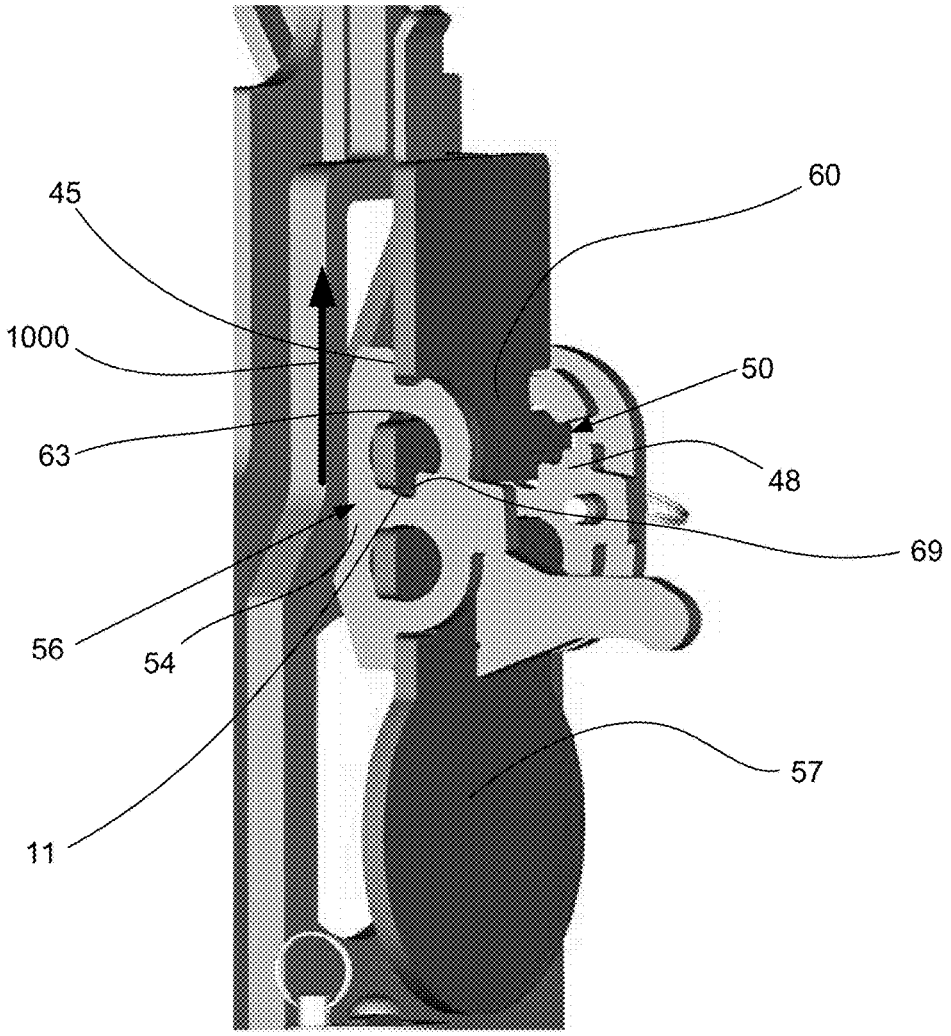
FIG. 16 is a close up perspective view showing a target support receiving a target projection.

It is to be mentioned that the first and second cam shaped openings 50, 56 may be embedded in other suitable holder bodies 48, 54, as shown in FIG. 16. Indeed, as shown in FIG. 16, again, because of the angle of about 20° that is present between the target 57 and the vertical, when a shooter hits the target 57, a vertical component of the force provided by the bullet will allow the target projection 60, which was laying in the cam recess 11 on the wall 69, to move up out and out of the cam recess 11 in the direction of arrow 1000 (directed by the wall 69) over the recess lip 65 (FIG. 5). According to the configuration of the wall 69, which is slightly higher than the recess lip 65, target projection 60 will travel along the redirection lip 63 and will thereby cause the target 57 to rotate (counterclockwise in FIG. 16) and move up in its substantially horizontal position, so that the target 57 does not rest on the substantially vertical rest surface 45 (best shown in FIG. 4) anymore.

Still referring to FIG. 5, in combination with FIGS. 1 and 2, it should be noted that the substantially horizontal blocking portion 47 of the first and second holder bodies 48, 54 will force the target support 44 to remain under the first elongated projection 32 of the elongated target receiving member 16 and hence prevent the target support 44 from moving under the force of the bullet impact.

Figure 7:
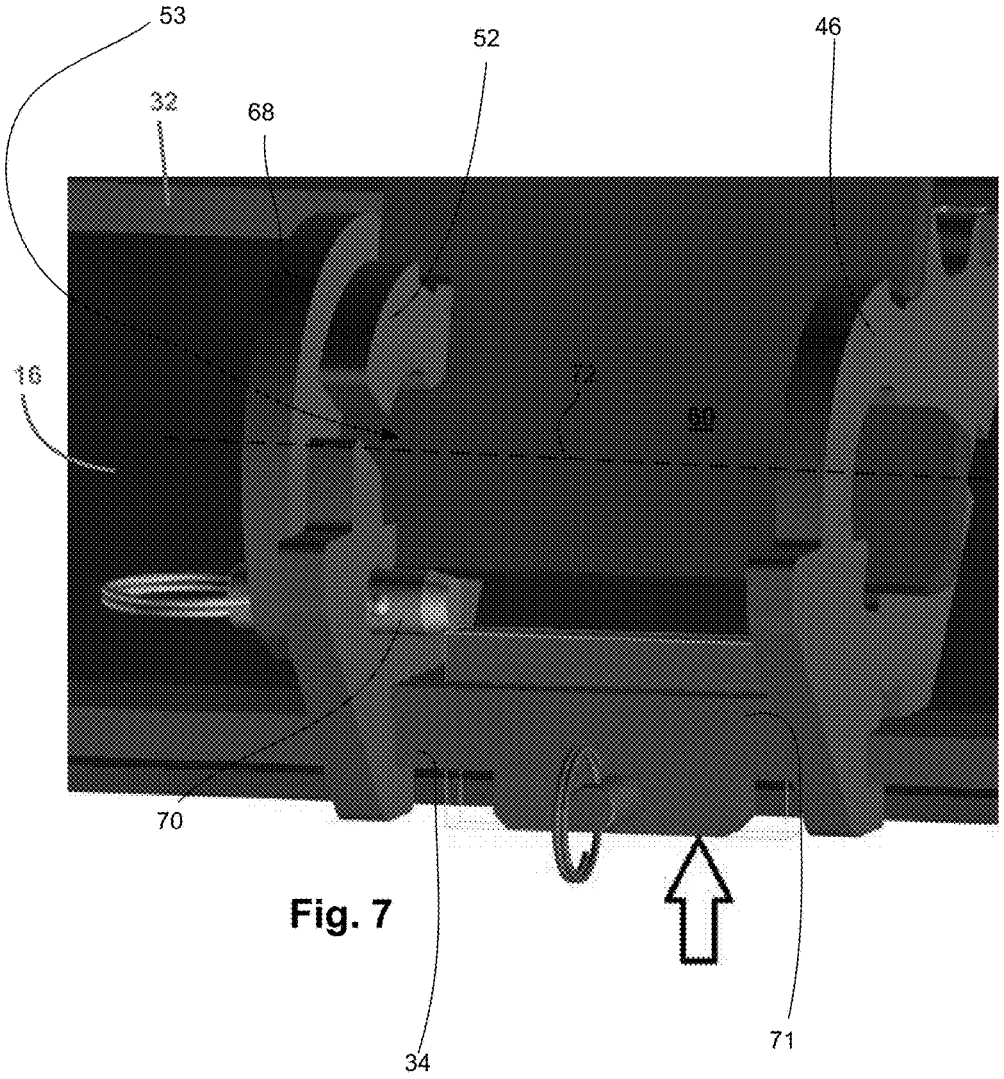
FIG. 7 is another close up perspective view of the first attachment system of FIG. 5, showing the target support receiving a target projection and further showing a mounting member for mounting the target support to the main frame.

Particularly referring to FIGS. 1 and 7, it is to be mentioned that the first and second target holders 46, 52 are releasably mounted on the elongated target receiving member 16 of the main frame 10 using the first and second elongated projections 32, 34. Indeed, a first target holder 46 will be received in the channels 36, 38 in between the first and second elongated projections 32, 34. Furthermore, a second target holder 52 will be received adjacent the first target holder 46 in channels 36, 38 in between the first and second elongated projections 32, 34 of the elongated target receiving member 16 of the main frame 10.

Figure 14:
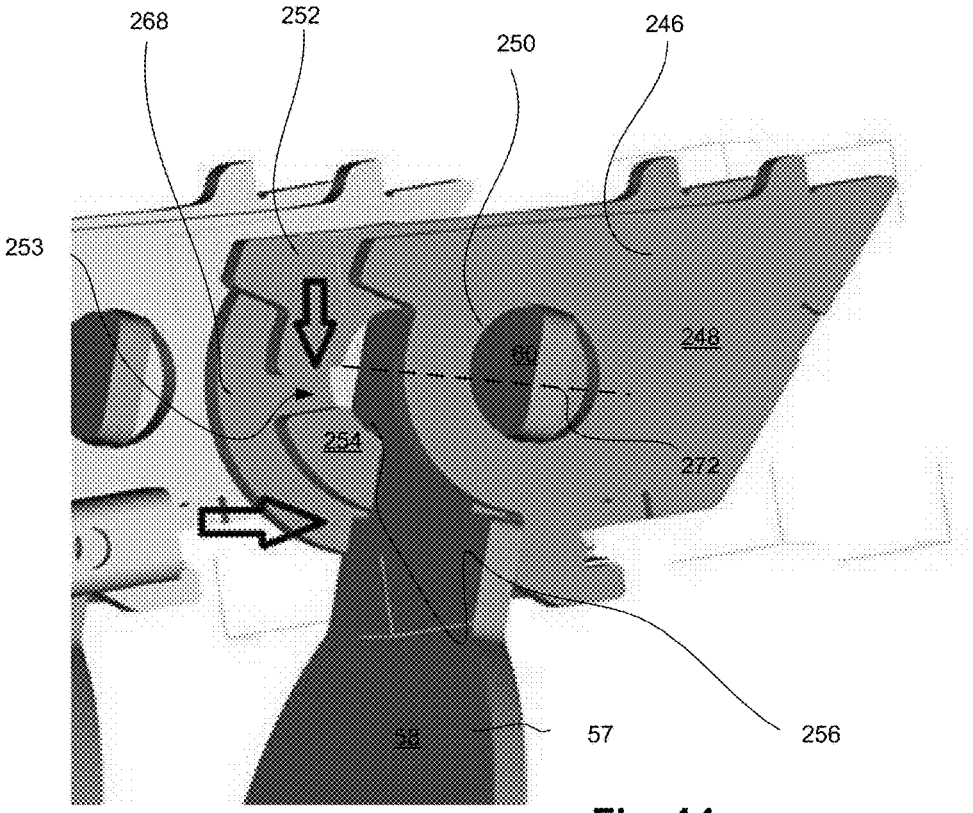
FIG. 14 is a close up perspective view of the second attachment system of FIG. 10, showing a target support receiving a target projection.

Still referring to FIGS. 2-8 and particularly to FIGS. 6 and 7, there is shown that each target support 44 further includes a retainer portion 68. The retainer portion 68 is pivotably mounted on the second target holder 52 and takes the shape of half a ring-like portion (best seen showing equivalent retainer portion 268 on FIG. 14). It is shown that for allowing the user to introduce a target 57 in between the first and second target holders 46, 52, the retainer portion 68 is pivotable relative to the second target holder 52 between an opened position (insertion of a target 57 position) and a closed position (in use position). Therefore, to lock the target projection 60 in between the first and second target holders 46, 52 and within the first and the second cam shaped openings 50, 56, the user needs to introduce a first side (rightmost side) of the target projection 60 within the first cam shaped opening 50 and then to introduce a second side (leftmost side) of the target projection 60 within the second cam shaped opening 56 via the insert channel 53 of the second target holder 52. Afterward, the user will need to lock the retainer portion 68 in its closed position (in use position) with the second target holder 52, thereby rendering non-functional the insert channel 53, using a connector (such as an elongated pin 70).

Now referring to FIGS. 2-8 and particularly to FIG. 6, there is better shown that each target support 44 further includes a mounting member 62 from which the first and second target holders 46, 52 extend and for mounting on the second (lowermost) elongated projection 34 of the elongated target receiving member 16. Indeed, the first and second target holders 46, 52 will interface with two adjacent channels 38 (from FIG. 1) on second (lowermost) elongated projection 34, while a portion of the mounting member 62 will be received in the slot 39 (from FIG. 1) defined in that second (lowermost) elongated projection 34 and in the slot 23 in joining member 71. The mounting member 62 defines a connection opening 66 which will receive a connector (such as an elongated pin 67) to mount the target support 44 (the first and second target holders 46, 52) on the second elongated projection 34 and therefore, on the elongated target receiving member 16.

Referring particularly to FIG. 6 and FIG. 7, it is to be noted that the first holder body 48 of the first target holder 46 takes the shape of a closed ring-like portion, but that the second holder body 54 of the second target holder 52 (the fixed part) takes the shape of an opened ring-like portion (defining the insert channel 53) for allowing the target projection 60 extending from the target body 58 to pivot about horizontal rotation axis 72 defined by the first and second cam shaped openings 50, 56 of the first and second holder bodies 48, 54.

Referring particularly to FIG. 6 and FIG. 3, the mounting member 62 allowing the connection between a target support 44 and the main frame 10 allows for maintaining each target support 44 in place and further allows to mount and/or to demount the first target attachment system 42 on the main frame 10 rapidly and/or easily. Furthermore, it is to be mentioned that mounting member 62 is positioned at an optimal position (hidden behind the elongated target receiving member 16, (FIG. 1)) so that it is not constantly hit by bullets coming in from the direction of main frame 10 and of first target attachment system 42. Because only elongated pins 67 are required to attach each target support 44 on the main frame 10, it is easy and user friendly to mount and/or demount the first target attachment system 42 to main frame 10.

Now referring to FIGS. 5, 6 and 7, it is to be mentioned that the first and second cam shaped openings 50, 56 defined within the first and second holder bodies 48, 54 are configured such as to control the movement of the target 57 (or of the target projection 60) about horizontal rotation axis 72 in between the first and second target holders 46, 52 of a target support 44. This configuration allows the targets 57 to maintain their initial position (so that they do not fall down accidently) even if the main frame 10 itself is hit by a bullet.

Therefore, according to the configuration of the first target attachment system 42, it is only when a user/a shooter hits a target 57 that the target will undergo enough force to be displaced from its shooting position to its hit or shot position (i.e., that the target 57 will "fall").

Figure 8:
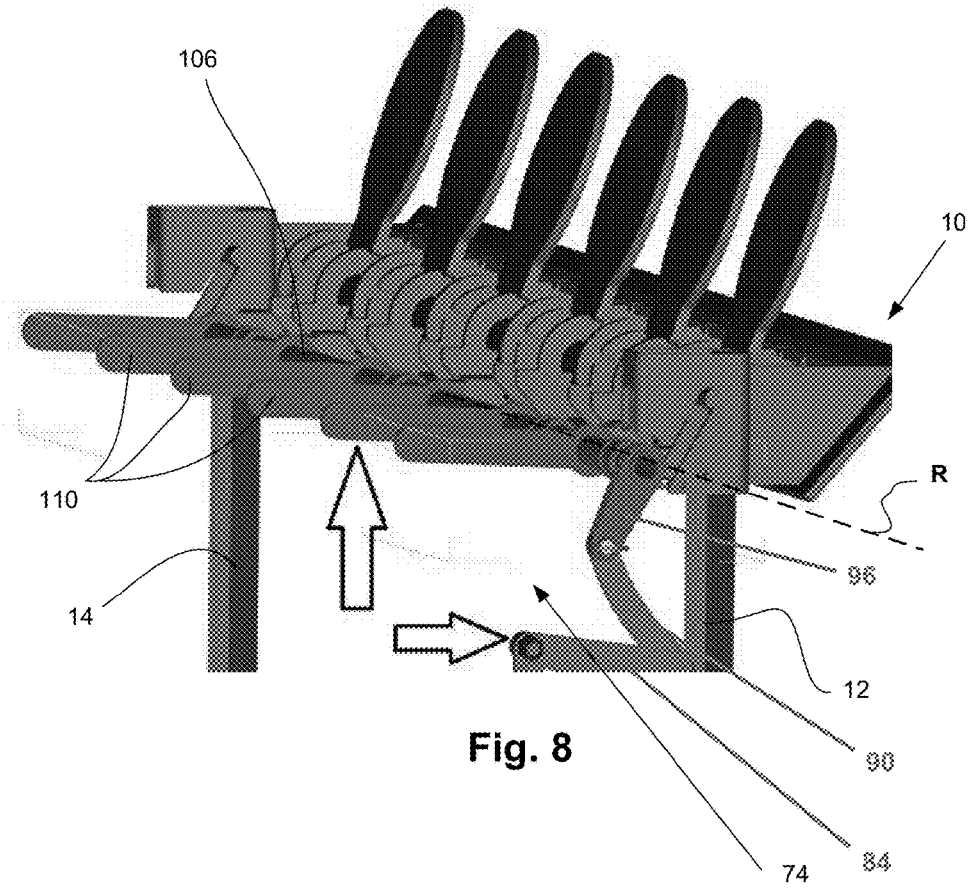
FIG. 8 is a perspective view of a first target attachment system releasably mounted on the main frame in accordance with another embodiment, where the main frame further includes a reset mechanism.
Figure 9:
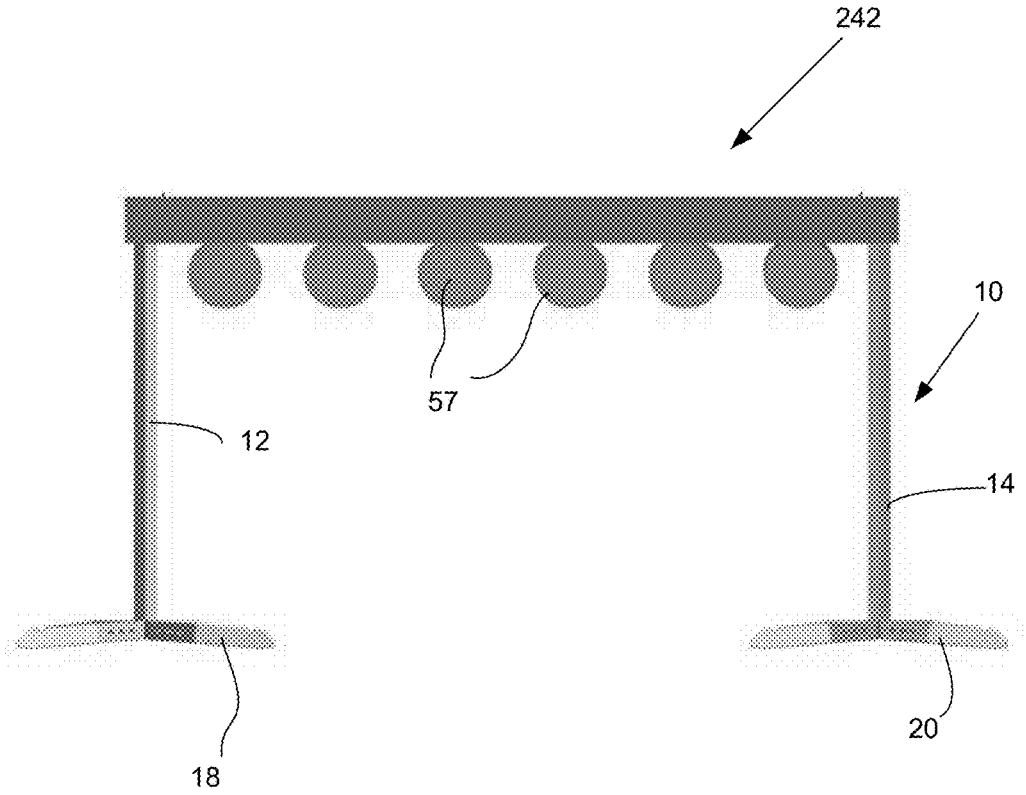
FIG. 9 is a front elevation view (shooter's point of view) of a second target attachment system releasably mounted on the main frame of FIG. 1 in accordance with another embodiment.

According to another embodiment and referring to FIGS. 3 and 8, the main frame 10 may further include a reset mechanism 74, a.k.a. target repositioning mechanism, such as to reset the initial configuration of the targets 57. The reset mechanism 74 includes a lever 76 mounted on the first elongated post 12 of the main frame 10. The lever 76 includes a first segment 78 with a first end 80 and a second end 82, a second segment 84 with a first end 86 and a second end 88, a third segment 90 with a first end 92 and a second end 94 and a fourth segment 96 with a first end 98 and a second end 100.

The lever 76 further includes a second segment cover 102 for covering the second segment 84. The first segment 78 includes at its first end 80 an opening 104 for allowing the user/shooter to attach a rope or any other suitable equipment. The second segment 84, at its first end 86, pivotably extends from the second end 82 of the first segment 78. The third segment 90, at its first end 92, pivotably extends from the second end 88 of the second segment 84. The fourth segment 96, at its first end 98, pivotably extends from the second end 94 of the third segment 90. The second segment cover 102 is fixedly mounted on the first elongated post 12 and allows pivot of the third segment 90 relative to the second segment 84.

Still referring to the reset mechanism 74, the reset mechanism 74 further includes an elongated rod member 106 extending from the second end 100 of the fourth segment 96. The elongated rod member 106 is releasably mounted on the plurality of extending members 40 of the main frame 10. The reset mechanism 74 further includes a plurality of ring portions 108 for receiving the elongated rod member 106 and for releasably connecting with the plurality of extending members 40 of the main frame 10.

The reset mechanism 74 further includes a plurality of push arms 110 extending from the elongated rod member 106 away from the elongated target receiving member 16. Each push arm 110 extending from the elongated rod member 106 is aligned with an independent target support 44 such that when the user/shooter pulls on the first segment 78 of the lever 76 (via a rope for example), the elongated rod member 106 will rotate about a rotational axis R within the plurality of ring portions 108. Therefore, the push arms 110, which are fixedly extending from the elongated rod member 106, will rotate between a first position (where at least one of the targets 57 is laying substantially parallel to the ground surface) and a second push position (where at least one of the targets 57 will be pushed to its initial shooting position substantially perpendicular to the ground surface). Therefore, push arms 110 apply a force on the targets 57 forcing movement of the targets towards their shooting position. It is to be mentioned that the push arms 110 may take any other suitable shape or configuration such as to be capable of displacing the targets 57 from their shot position and to their shooting position.

According to another embodiment, and referring now to FIGS. 9-15, there is shown that the main frame 10 receives a second target attachment system 242. According to the second target attachment system 242, the targets 57 are installed on the main frame 10 using a different set of target holders that are inverted (i.e., when in their shooting positions, the targets 57 are extending downwardly from the elongated target receiving member 16 of main frame 10). The second target attachment system 242 includes a plurality of spaced apart target supports 244 to be removably mounted on the elongated target receiving member 16 of the main frame 10. Each one of the target supports 244 includes a first target holder 246 which includes a first holder body 248 and a first opening 250 therethrough. Each target support 244 further includes a second target holder 252 which is laterally distant from the first target holder 246. The second target holder 252 includes a second holder body 254 and a second opening 256 therethrough.

As shown in FIGS. 9-15, targets 57, which are to be releasably mounted to the second target attachment system 242, each includes a target body 58 and a target projection 60, which extends from the target body 58 (as described above). It is the target projection 60 that will cooperate with the first and second openings 250, 256 of the first and second target holders 246, 252. The first and second target holders 246, 252 are attached together via joining member 271 which has a slot 269 therein (not shown).

It is to be mentioned that the first and second target holders 246, 252 are releasably mounted on the elongated target receiving member 16 of the main frame 10 using the first and second elongated projections 32, 34 (FIG. 1). Indeed, a first target holder 246 will be received in the channels 36, 38 (FIG. 1) in between the first and second elongated projections 32, 34. Furthermore, a second target holder 252 will be received adjacent the first target holder 246 in channels 36, 38 in between the first and second elongated projections 32, 34 of the elongated target receiving member 16 of the main frame 10.

Still referring to FIGS. 9-15, there is shown that each target support 244 further includes a retainer portion 268. The retainer portion 268 is pivotably mounted on the second target holder 252 and takes the shape of half a ring-like portion. As shown, for allowing the user to introduce a target 57 in between the first and second target holders 246, 252, the retainer portion 268 is pivotable relative to the second target holder 252 between an opened position (insertion of a target 57 position) and a closed position (in use position). Therefore, to lock the target projection 60 in between the first and second target holders 246, 252 and within the first and the second openings 250, 256, the user/shooter needs to introduce a first side (rightmost side) of the target projection 60 within the first opening 250 and then to introduce a second side (leftmost side) of the target projection 60 within the second opening 256 via the insert channel 253 of the second target holder 252. Afterward, the user will need to lock the retainer portion 268 in its closed position (in use position) with the second target holder 252 using a connector (such as an elongated pin (not shown) to be inserted in a connection opening 270).

Figure 15:
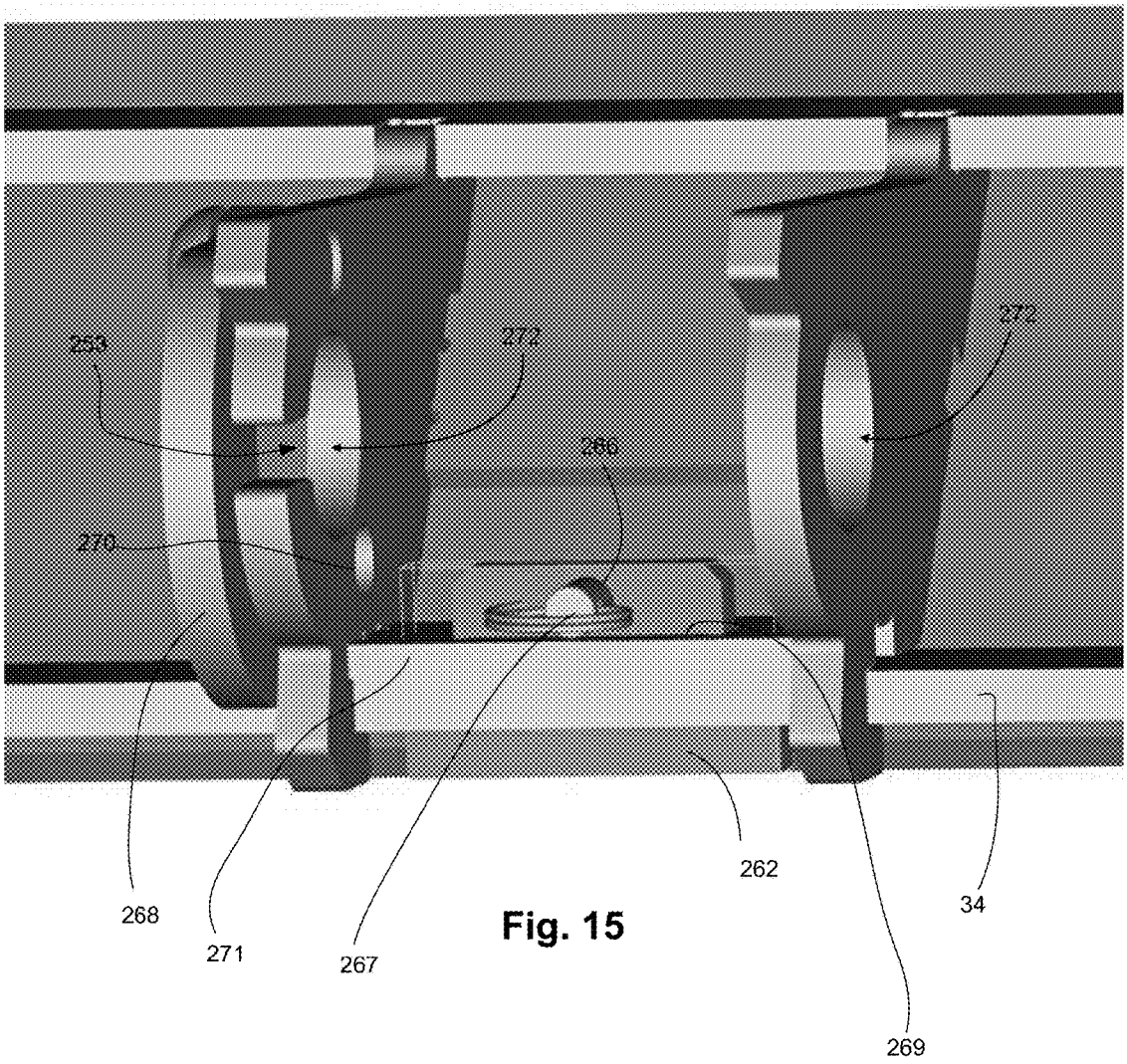
FIG. 15 is a close up perspective view of the second attachment system of FIG. 10, showing a mounting member for mounting the target support to the main frame.

Now referring to FIG. 15 (and FIG. 1 for parts 16, 34, 28, 39, 58 and 60), there is better shown that each target support 244 further includes a mounting member 262 from which the first and second target holders 246, 252 extend and for mounting on the second (lowermost) elongated projection 34 of the elongated target receiving member 16. Indeed, the first and second target holders 246, 252 will interface with two adjacent channels 38 on second (lowermost) elongated projection 34, while a portion of the mounting member 262 will be received in the slot 39 defined in that second (lowermost) elongated projection 34 and in the slot 269 in joining member 271. The mounting member 262 defines a connection opening 266 which will receive a connector (such as an elongated pin 267) to mount the target support 244 (the first and second target holders 246, 252) on the second elongated projection 34 and therefore, on the elongated target receiving member 16.

It is to be noted that the first holder body 248 of the first target holder 246 takes the shape of a closed ring-like portion, but that the second holder body 254 of the second target holder 252 (the fixed part) takes the shape of an opened ring-like portion (defining the insert channel 253) for allowing the target projection 60 extending from the target body 58 to access the passage 272 defined by the first and second openings 250, 256 of the first and second holder bodies 248, 254.

Still referring to FIG. 15, the mounting member 262 allowing the connection between a target support 244 and the main frame 10 maintains each target support 244 in place and further allows to mount and/or to demount the second target attachment system 242 on the main frame 10 rapidly and/or easily. Furthermore, it is to be mentioned that mounting member 262 is positioned at an optimal position (hidden behind the elongated target receiving member 16, (FIG. 1)) so that it is not constantly hit by bullets coming in from the direction of main frame 10 (elongated pin 267 is now mounted above the second elongated projection 34) and of second target attachment system 242. Because only elongated pins 267 are required to attach each target support 244 on the main frame 10, it is also easy and user friendly to mount and/or demount the second target attachment system 242 to main frame 10.

Figure 10:
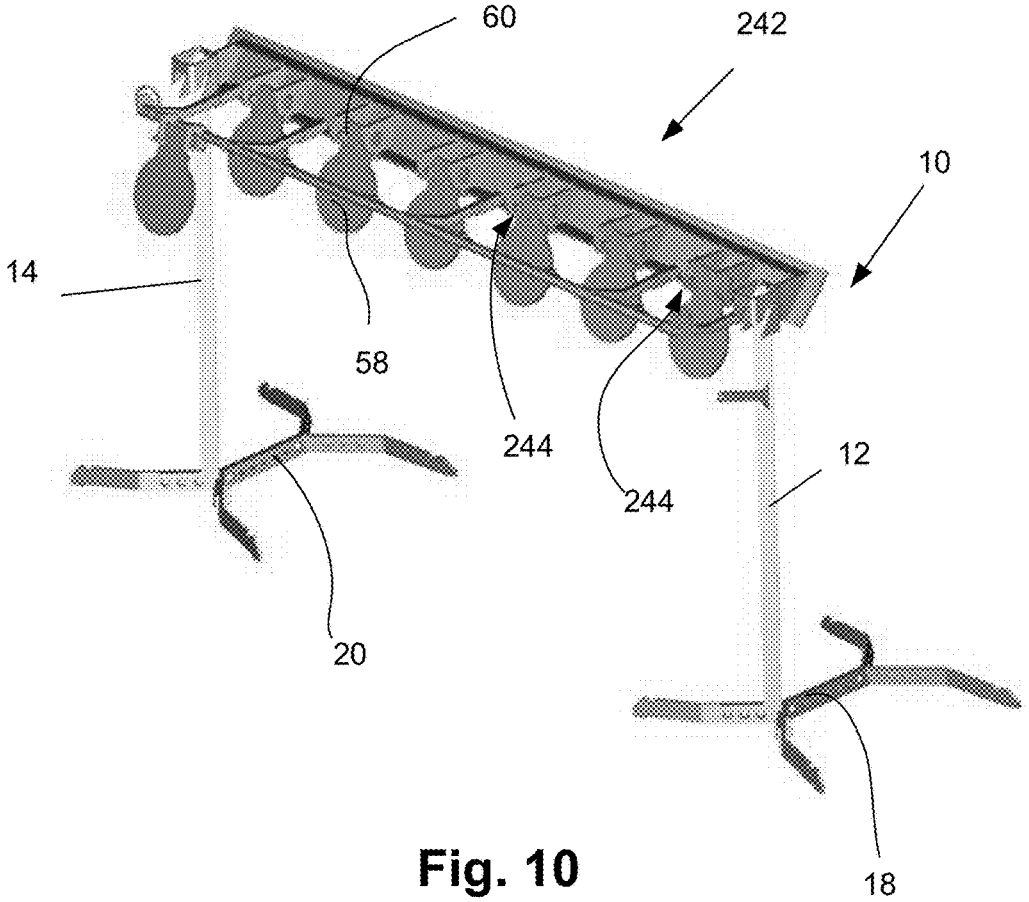
FIG. 10 is a rear perspective view of the second attachment system releasably mounted on the main frame of FIG. 3.
Figure 11:
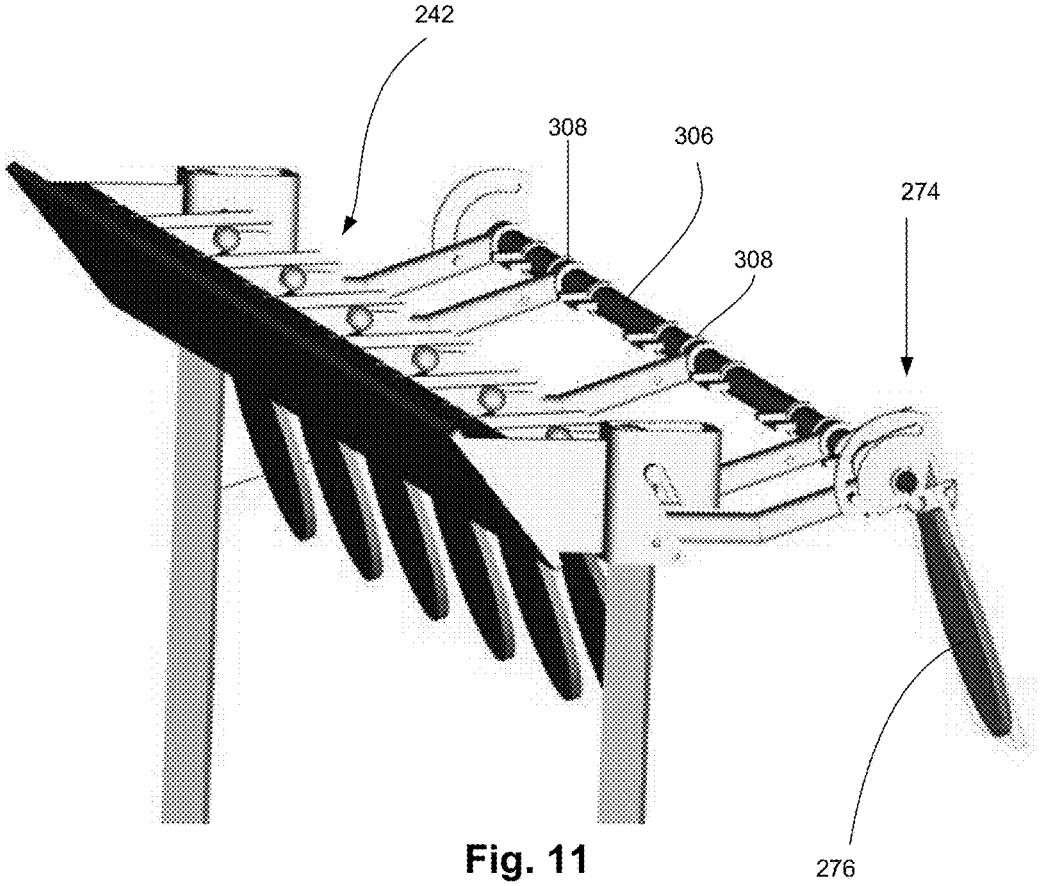
FIG. 11 is a perspective view of a second target attachment system mounted on the main frame in accordance with another embodiment, where the main frame further includes a reset mechanism.
Figure 12:
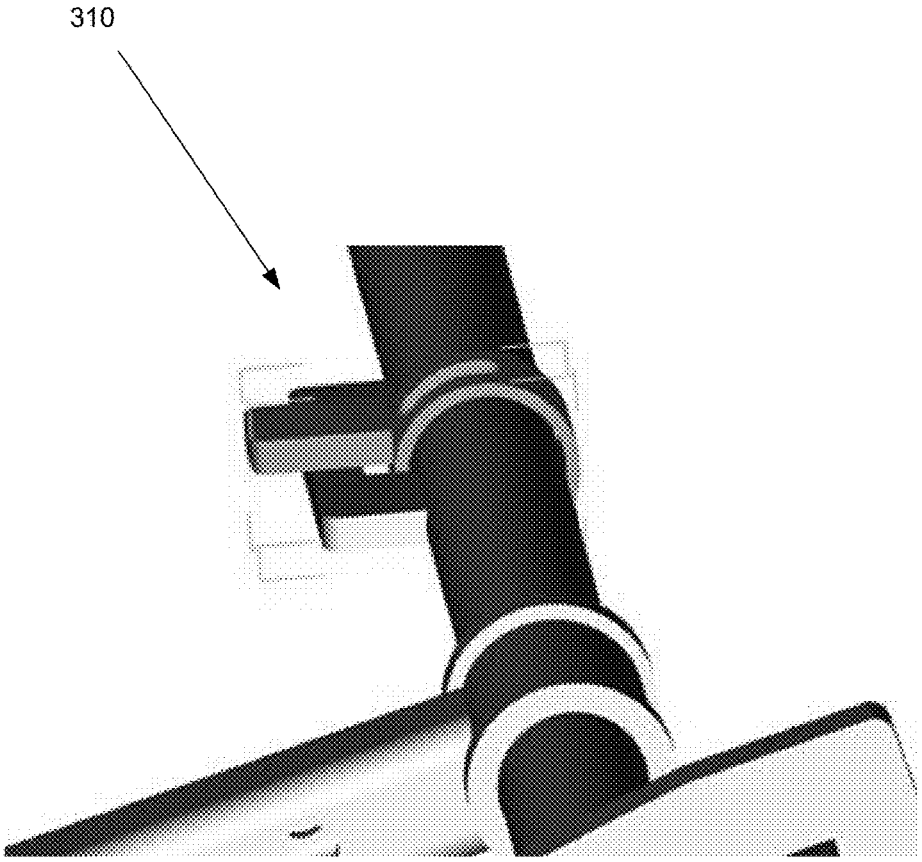
FIG. 12 is a close up perspective view of the reset mechanism of FIG. 11, showing a stopping arm for stopping a target.
Figure 13:
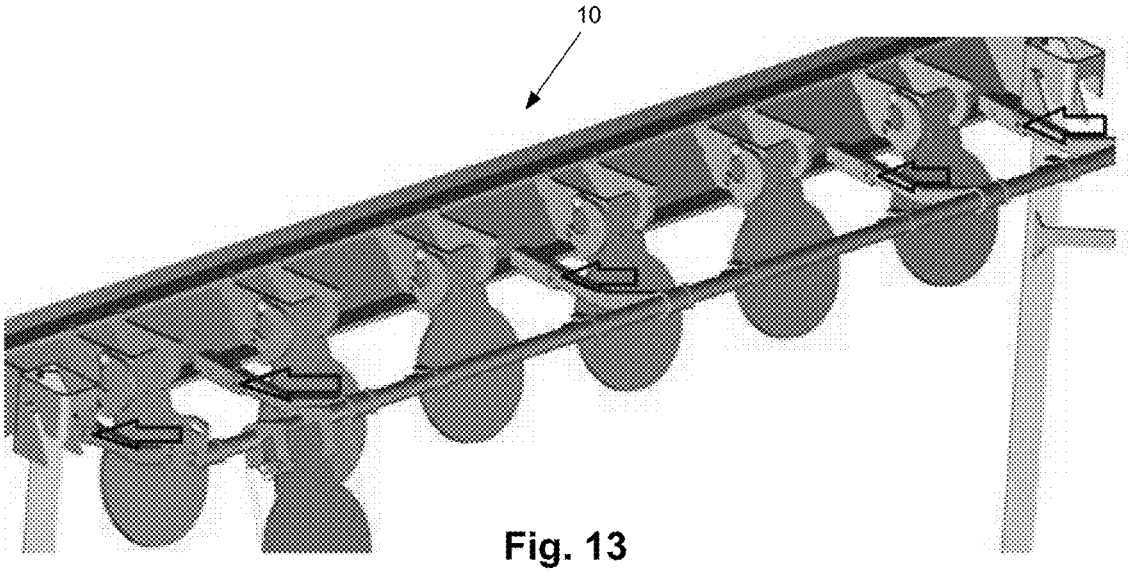
FIG. 13 is another rear perspective view of the second target attachment system mounted on the main frame of FIG. 11.

According to another embodiment and referring to FIGS. 10, 11 and 13, the main frame 10 further includes a reset mechanism 274, a.k.a. a target repositioning mechanism, such as to reset the initial configuration of the targets 57 (The shooter may want to bring back the targets 57 down). The reset mechanism 274 includes a reset target 276 pivotally mounted on the first elongated post 12 of the main frame 10. Reset target 276 is the trigger for the auto reset system that stops the six targets from falling back in shooting position helping the shooter to see if he has hit the targets 57. The reset target 276 is held in a bracket that is welded to the shaft so that when the reset target 276 (the seventh target) is hit, the elongated rod member 306 will simply spin and release the other targets 57. Still referring to the reset mechanism 274, the reset mechanism 274 further includes an elongated rod member 306 extending from the reset target 276 in a direction parallel to the elongated target receiving member 16. The elongated rod member 306 is releasably mounted on the plurality of extending members 40 of the main frame 10. The reset mechanism 274 further includes a plurality of ring portions 308 for receiving the elongated rod member 306 and for releasably connecting with the plurality of extending members 40 of the main frame 10. The reset mechanism 274 further includes a plurality of stopping arms 310 extending from the elongated rod member 306 towards the elongated target receiving member 16. Each stopping arm 310 extending from the elongated rod member 306 is aligned with an independent target support 244 such that when the user/shooter shoots on the reset target 276, the elongated rod member 306 will rotate about a rotational axis R within the plurality of ring portions 308. Therefore, the stopping arms 310, which are fixedly extending from the elongated rod member 306, will rotate between a first position (where at least one of the targets 57 is laying substantially parallel to the ground surface) and a second push position (where at least one of the targets 57 will be pushed to its initial shooting position substantially perpendicular to the ground surface and downwardly extending from the elongated target receiving member 16). It is to be mentioned that the stopping arms 310 may take any other suitable shape or configuration such as to be capable of stopping the targets 57 between their shooting position and their shot/hit position. The mechanism stopping the targets 57 from falling back is a free floating ring with a stopper welded that is long enough to stop the targets 57 on their way back to their shooting positions. The installation of the reset mechanism 274 is therefore performed easily with five elongated ball pins and can be made without tools.

The main frame 10 and the target attachment systems 42, 242 described above provides a complete target system for shooting ranges that is user-friendly, that is tough and that offers multiples uses using a single main frame 10 (offers a plurality of different scenarios to the shooters).

It is to be mentioned that the second target attachment system is mostly for longer range and higher power rifles.

The main frame 10 and the target attachment systems 42, 242 and the target systems combining them described above provide greater flexibility to the users/shooters.

The main frame 10 and the target attachment systems 42, 242 described above may be used as a standard plate rack or, in only a few minutes and without any tool, may be transformed to a full size gravity plate rack with an auto-reset (and vice versa).

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. A target attachment system for mounting to a main frame and for holding a target movable between a shooting position and a shot position, the target having a target body and a target projection extending therefrom, the target attachment system comprising:

a pair of target holders for mounting to the main frame distant from each other, each one of the target holders comprising:

a target mounting face for mounting on the main frame; and a holder body having an opening therethrough;

wherein the target holders are mounted as a pair, thereby defining a pair of openings creating a horizontal passage having a rotation axis therein, wherein the horizontal passage is adapted to receive the target projection and whereby the target, when hit, rotates about the rotation axis from the shooting position to the shot position, and wherein one of the target holders has an open ring-shaped frame portion defining an insert channel creating a passage for the target projection to the opening, the one of the target holders further comprising a retainer portion adapted to be placed in a first position freeing the insert channel and in a second position obstructing the insert channel and thereby preventing the target projection from exiting the opening.

2. The target attachment system of claim 1, wherein each opening comprises an interior arch, and wherein each opening has a rest surface within the interior arch on which abuts the target in a rest angle whereby the target is partially facing a ground surface.

3. The target attachment system of claim 2, wherein each opening has an abutment surface in the interior arch where the target abuts to stop a rotation of the target around the rotation axis.

4. The target attachment system of claim 3, wherein the interior arch has an irregularity between the rest surface and the abutment surface, wherein the irregularity provides resistance against the target rotating around the rotation axis away from the rest angle.

5. The target attachment system of claim 1, wherein each of the target holders has an exterior face distant from the target mounting face, the exterior face comprising an exterior arch, and wherein the target holders comprise a rest surface on the exterior arch on which abuts the target in a rest angle whereby the target is partially facing a ground surface.

6. The target attachment system of claim 5, wherein the target holders further comprise an abutment surface on the exterior arch where the target abuts to stop a rotation of the target around the rotation axis.

7. The target attachment system of claim 6, wherein the exterior arch comprises an irregularity between the rest surface and the abutment surface, wherein the irregularity provides resistance against the target rotating around the rotation axis away from the rest angle.

8. The target attachment system of claim 1, further comprising a mounting member adapted for securing together a first one of the target holders, a second one of the target holders and the main frame.

9. The target attachment of claim 1, wherein each opening is cam shaped.

* * * * *